US005348205A

United States Patent [19]

Steurer

[11] Patent Number: 5,348,205

[45] Date of Patent: Sep. 20, 1994

[54] GOLF DUAL SHOULDER STRAP

[75] Inventor: Steven T. Steurer, Louisville, Ky.

[73] Assignee: Brunswick Bowling & Billards, Lake Forest, Ill.

[21] Appl. No.: 54,767

[22] Filed: Apr. 27, 1993

[51] Int. Cl.[5] ..... A45C 13/00

[52] U.S. Cl. ..... 224/209; 224/259; 224/257; 224/214; 206/315.3

[58] Field of Search ..... 224/202, 209–214, 224/204, 205, 250, 257, 258, 259–264, 251, 249; 206/315.3, 315.2, 315.5

[56] References Cited

U.S. PATENT DOCUMENTS

| | | | |
|---|---|---|---|
| 1,951,492 | 3/1934 | Schneider . | |
| 2,533,440 | 12/1950 | Endee . | |
| 2,820,498 | 1/1958 | Endee . | |
| 2,853,111 | 9/1958 | Williams | 224/259 |
| 4,487,347 | 12/1984 | Zegar | 224/259 |
| 4,911,347 | 3/1990 | Wilhite | 224/259 X |
| 5,038,984 | 8/1991 | Izzo | 224/209 |
| 5,042,654 | 8/1991 | Jones | 206/315.3 |
| 5,042,703 | 8/1991 | Izzo | 224/209 |
| 5,042,704 | 8/1991 | Izzo | 224/209 |
| 5,215,239 | 6/1993 | Walters, Jr. | 224/259 |

FOREIGN PATENT DOCUMENTS

| | | | |
|---|---|---|---|
| 338365 | 12/1903 | France | 224/209 |

*Primary Examiner*—Ernest G. Cusick
*Attorney, Agent, or Firm*—Wood, Phillips, VanSanten, Hoffman & Ertel

[57] ABSTRACT

A golf bag in the form of a tubular receptacle with a handle thereon has a dual-loop two-point shoulder strap for engaging both shoulders of an individual carrying the golf bag. The shoulder strap, in one embodiment, has a single elongated belt with mutually opposed belt ends. One belt end and a first portion of the belt between the belt ends is connected to a first point on a golf bag and defines a first loop through which an individual inserts one arm to support the golf bag at least partially on one shoulder. The other belt end and a second portion of the belt between the belt ends is connected to a second point on the golf bag and defines a second loop through which an individual inserts another arm to support the golf bag at least partially on another shoulder.

11 Claims, 5 Drawing Sheets

GOLF DUAL SHOULDER STRAP

BACKGROUND OF THE INVENTION

1. Technical Field

The present invention relates to golf, and more particularly is directed toward a shoulder strap for carrying a golf bag.

2. Background Art

It is generally well known in the sport of golf to carry a golf bag loaded with golf clubs and related golf equipment by means of a flexible strap which is attached at one end to a point adjacent the top or open end of the bag and at the other end to a point toward the bottom of the bag. The strap is typically supported on the shoulder and/or back of a carrier of the bag as the individual maneuvers about a golf course.

Due to the significant weight typically associated with golf equipment, the task of lugging a loaded golf bag during a game of golf (over the course of which a golfer may walk many miles) can be oppressively uncomfortable. Not only does the static weight of the golf equipment bear painfully on the shoulders and back of a golfer, but a golf bag has a tendency to bounce and shift as a golfer traverses the hills and rolling fairways found on golf courses. The tendency of a golf bag to slip not only intensifies the pain of supporting the loaded golf bag but, in addition, demands that a golfer expend energy merely to control the orientation of the bag and prevent contents of the golf bag from spilling.

One attempt which has been made to eliminate the discomfort and slipping tendency of a golf bag has been to support the weight of the bag on both shoulders of a golfer or caddie. For instance, Izzo U.S. Pat. No. 5,042,704 shows a golf bag having adjacent ends of two separate straps joined at a pivot point on the golf bag. The junction (pivot point) is movable relative to the golf bag. Opposite ends of the strap are fixedly secured to the bag at points spaced from the pivot point. Prior golf bag straps proposed for engaging both shoulders of a golfer generally have failed to reduce the level of discomfort and resulting fatigue to an acceptable level and have proved to be unsatisfactory.

A need exists, therefore, for a carrying strap which facilitates handling of a golf bag by alleviating the discomfort which typically is associated with carrying golf equipment and by reducing the effort required to control the orientation of a carried golf bag. The present invention is directed toward overcoming one or more of the problems set forth above.

SUMMARY OF THE INVENTION

In accordance with the present invention, a shoulder strap for carrying a golf bag has a first loop and a second loop. The first loop is attached to a first connection point on the bag whereby an individual inserts one arm through the first loop to support the golf bag at least partially on one shoulder. A second loop is attached to a second connection point on the bag spaced from the first connection point whereby the individual inserts another arm through the second loop to support the golf bag at least partially on another shoulder.

In one aspect of the invention, the first loop consists of a first elongated belt having mutually opposed belt ends. One of the first belt ends is connected to one of the spaced apart connection points and the other of the first belt ends is connected to the one first belt end. The second loop consists of a second elongated belt having mutually opposed belt ends. One of the second belt ends is connected to the other of the spaced apart connection points and the other of the second belt ends is connected to the one second belt end. Preferably, the length of at least one of the belts can be varied for adjusting the size of the loop defined thereby.

In one embodiment, a secondary support point on the golf bag is engageable with at least one of the first and second loops at a point intermediate the ends of the belt defining the one loop. In one form, the secondary support point is movable relative to the golf bag.

In another embodiment, the shoulder strap has a single belt with mutually opposed belt ends for collectively defining both the first loop and the second loop. Both ends of one of the belts are attached to the golf bag at one of the connection points to define the first loop. The ends of the other belt are attached to the golf bag at the other of the spaced apart connection points to define the second loop.

The present invention is envisioned for use with a golf bag having a tubular receptacle with an elongated handle extending lengthwise in a direction between a closed lower end and an open upper end of the receptacle. Each end of a first belt is attached to one connection point on the handle and each end of a second belt is attached to a second point on the handle. At least one of the connection points is stationary relative to the receptacle.

In one form, the first belt and the second belt are interconnected by a third elongated belt, which is to say that the first loop and the second loop have a unitary construction. Interlocking strips are provided on the handle and extend lengthwise of the third belt for releasably attaching the third belt to the handle.

It can be understood, therefore, that the invention as disclosed herein contemplates a dual-loop two-point shoulder strap having a single elongated belt with mutually opposed belt ends wherein a) one belt end and a first portion of the belt between the belt ends is connected to a first point on a golf bag and defines a first loop through which an individual inserts one arm to support the golf bag at least partially on one shoulder, and b) the other belt end and a second portion of the belt between the belt ends is connected to a second point on the golf bag and defines a second loop through which an individual inserts another arm to support the golf bag at least partially on another shoulder.

BRIEF DESCRIPTION OF THE DRAWINGS

The features of this invention which are believed to be novel are set forth with particularity in the appended claims. The invention, together with its objects and advantages, may be understood from the following description taken in conjunction with the accompanying drawings, in which like reference numerals identify like elements in the figures and in which:

DESCRIPTION OF THE PREFERRED EMBODIMENT

Figure 1:
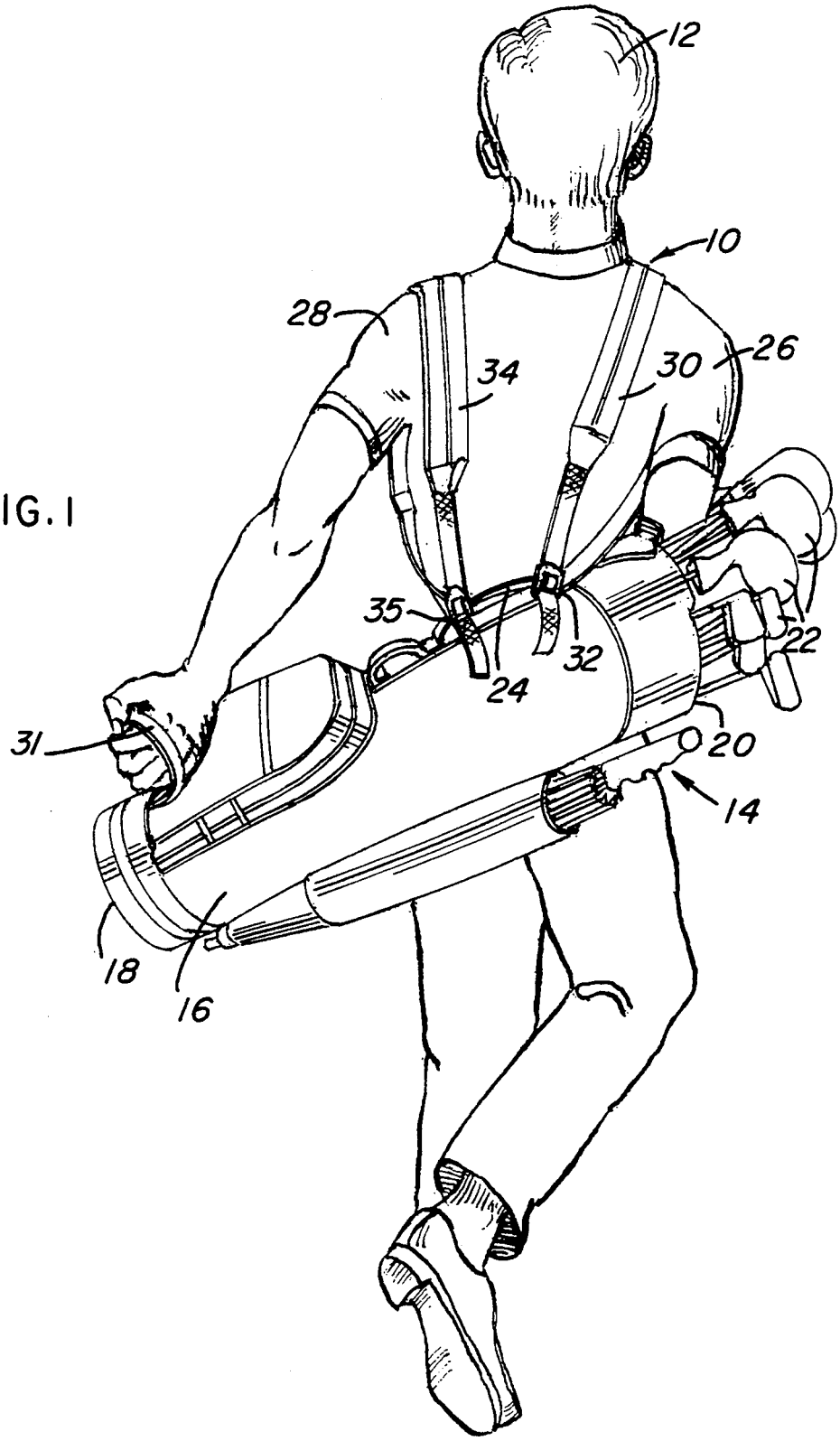
FIG. 1 is a perspective view of a golf bag comprising a golf shoulder strap according to the invention supported on the shoulders of a person carrying the bag.

A shoulder strap according to the present invention, generally designated 10 in FIG. 1, is used by an individual 12 to carry a golf bag 14. The golf bag 14 has a tubular receptacle 16 with a closed lower end 18 and an open upper end 20 for receiving the shafts of a plurality of golf clubs 22. A handle 24 extends lengthwise of the receptacle 16 between the closed end 18 and the open end 20. The handle 24 is used for handling the golf bag 14 by hand, such as, for example, when the golf bag 14 is lifted into or out of a golf cart, automobile, or when the golf bag 14 is, by choice of the golfer, carried by the handle.

The tubular receptacle 16 of the golf bag 14 has a metal frame, generally designated 21, with a ring shaped member 23 at the open end 20 and a similar ring shaped member or plate, not shown, at the closed lower end 18 joined by at least two ribs, 25,25 extending between the open end 20 ring shaped member 23 and the closed end 18 plate or ring member. A cloth, canvas, or similar material is used to form a covering 27 which encircles the metal frame 21 with a longitudinally extending web 29 of tough, strong material stitched to the covering 27 and secured to one of the ribs 25 at least in the vicinity of the handle 24 so that lifting the golf bag 14 by means of the handle 24 will transmit the lifting force from the handle 24 to the frame 21 of the golf bag 14. The handle is usually about two average hands long and is located on the upper half of the bag 14 above what would normally be considered the center of gravity of the bag so that when the bag or the bag loaded with clubs and other golfing gear (balls, etc.) is lifted, the open end 20 is raised first preventing the clubs 22 from exiting the golf bag 14.

As illustrated in FIG. 1, the golf strap 10 is adapted to engage both the shoulders 26 and 28 of the individual 12 and comfortably support the weight of the loaded golf bag 14 across the back of the individual 12 with the open golf bag end 20 positioned substantially above the closed golf bag end 18. In addition, the ends of a relatively short strip of resilient material 31, such as a strip of canvas or nylon, are fastened to the receptacle 16 near the bottom end 18 thereof, as by sewing, whereby the individual 12 can reach back and grasp the loop defined by the strip 31 to assist in controlling the position of the golf bag 14.

The shoulder strap 10 includes a first loop 30 connected to the golf bag 14 at a connection point 32 on the handle 24 and a second loop 34 connected to the golf bag 14 at a connection point 35 on the handle 24.

Figure 2:
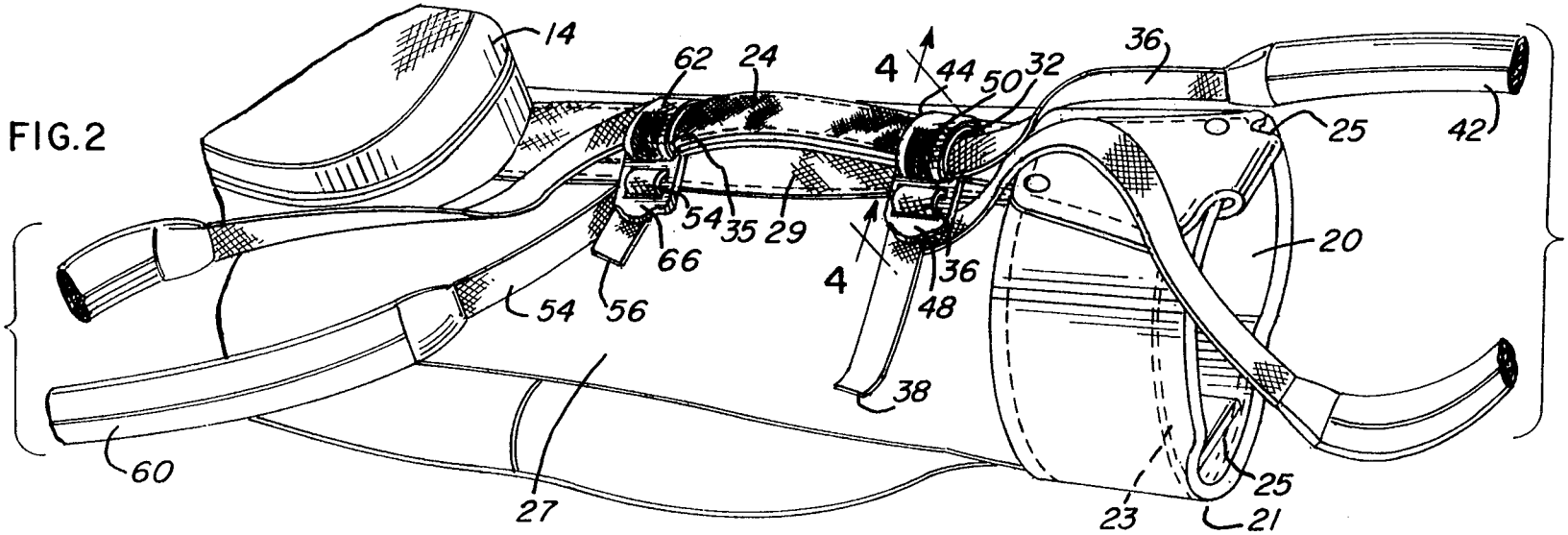
FIG. 2 is a fragmentary perspective view illustrating the connections between the shoulder strap and the golf bag.
Figure 3:
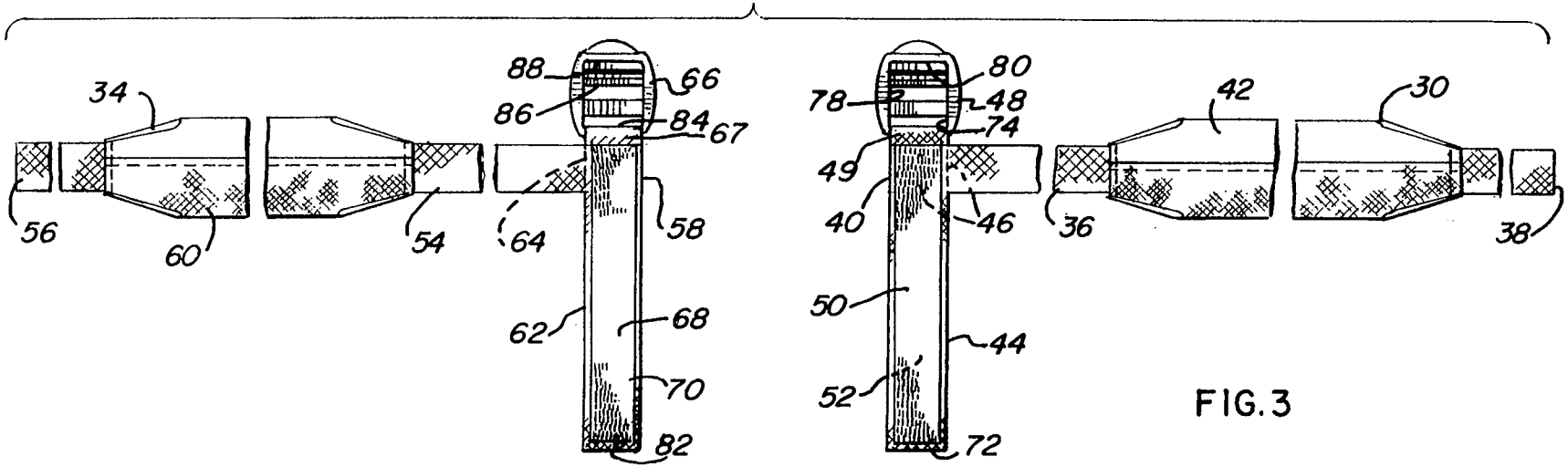
FIG. 3 is a fragmentary plan view illustrating the shoulder strap in a disassembled condition.
Figure 4:
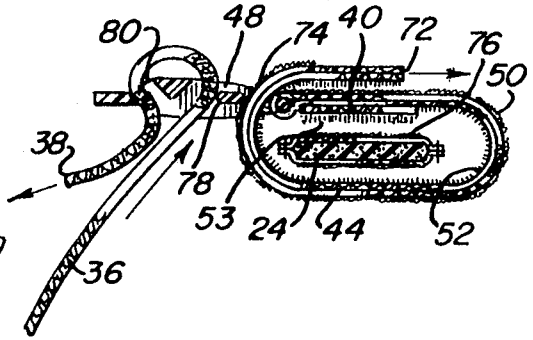
FIG. 4 is a sectional view taken along the line 4—4 in FIG. 2.

More particularly, and referring also to FIGS. 2–4, the loop 30 is defined by an elongated belt 36 having mutually opposed belt ends 38 and 40. A widened load distributing central portion 42 of the belt 36 preferably includes a foam pad or other cushion material suitable for reducing discomfort when the loop 30 bears against the shoulder of an individual carrying the golf bag 14. A fastening strip 44 extends transversely to the belt end 40 and is attached thereto by stitching 46. A slotted buckle 48 is pivotally fastened to the strip 44 by means of a loop 49 at the end of the strip 44. Strips of material 50 and 52 embodying interengageable hooks and loops, such as material marketed under the trademark VELCRO, extend lengthwise along opposite sides of the fastening strip 44. A VELCRO strip 53 is attached to the underside of the belt end 40 (FIG. 4).

The loop 34 is defined by an elongated belt 54 having mutually opposed belt ends 56 and 58. A widened load distributing central portion 60 of the belt 54 preferably includes a foam pad or other cushion material suitable for reducing discomfort when the loop 34 bears against the shoulder of an individual carrying the golf bag 14. A fastening strip 62 extends transversely to the belt end 58 and is attached thereto by stitching 64. A slotted buckle 66 is pivotally fastened to the strip 62 by means of a loop 67 at the end of the strip 62. Strips of material 68 and 70 embodying interengageable hooks and loops, such as material marketed under the trademark VELCRO, extend lengthwise along opposite sides of the fastening strip 62. A VELCRO strip (not shown) is attached to the underside of the belt end 58 similar to the strip 53 discussed above relative to the belt end 40.

The manner in which the ends of the elongated belts 36 and 54 are connected to the golf bag 14 to define the loops 30 and 34, respectively, is illustrated in FIG. 4 with regard only to the belt 36. It should be understood, however, that the invention contemplates that the belt 54 is attached to the golf bag 14 in a manner substantially identical to that now described relative to the belt 36.

The end 40 of the belt 36 is attached to the connection point 32 by wrapping the fastening strip 44 around the handle 24 and feeding the free end 72 of the strip 44 through a first slot 74 on the buckle 48. The end 72 is drawn tightly through slot 74 on the buckle and the VELCRO strips 50 and 52 on adjacent faces of the fastening strip 44 are pressed together so that the fastening strip 44 securely embraces the handle 24. A VELCRO strip 76 extends lengthwise along the outer surface of the handle 24 and engages the VELCRO strip 53 on the underside of the belt end 40 so that the connection point 32 remains substantially stationary relative to the golf bag 14 and handle 24.

The loop 30 is formed by attaching the end 38 of the belt 36 to the buckle 48. More specifically, the belt end 38 first is fed through a second slot 78 on the buckle 48. The length of the belt 36 which is fed through the slot 78 determines the size of the loop 30 and is adjustable to vary the position in which the golf bag 14 is carried. The belt end 38 then is drawn through a third slot 80 on the buckle 48 whereby the belt end 38 is securely bound in the buckle 48 and the loop 30 (that is, both ends 38 and 40 of the belt 36) is firmly attached to the golf bag 14 at the connection point 32.

The end 58 of the belt 54 is attached to the connection point 35 on the handle 24 by wrapping the fastening strip 62 around the handle 24 and feeding the free end 82 of the strip 62 through a first slot 84 on the buckle 66. The end 82 is drawn tightly through the buckle and the VELCRO strips 68 and 70 on adjacent faces of the fastening strip 64 are pressed together so that the fastening strip 64 securely embraces the handle 24. The VELCRO strip on the underside of the belt end 58 engages the VELCRO strip 76 on the outer surface of the handle 24 so that the connection point 35 remains substantially stationary relative to the golf bag 14 and handle 24.

The loop 34 is formed by attaching the end 56 of the belt 54 to the buckle 66. More specifically, the belt end 56 first is fed through a second slot 86 on the buckle 66. The length of the belt 54 which is fed through the slot 86 determines the size of the loop 34 and is adjustable to vary the position in which the golf bag 14 is carried. The belt end 56 then is drawn through a third slot 88 on the buckle 66 whereby the belt end 82 is securely bound in the buckle 66 and the loop 34 is firmly attached to the golf bag 14 at the connection point 35.

Figure 5:
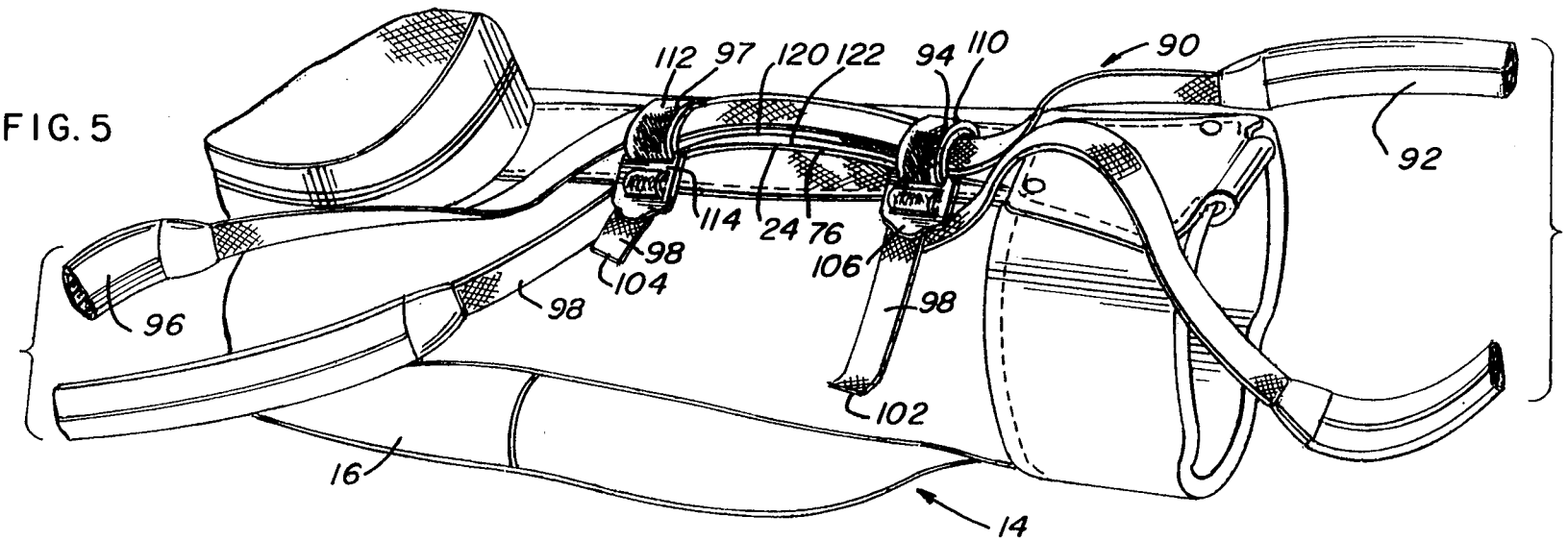
FIG. 5 is a fragmentary perspective view illustrating an alternative embodiment of the shoulder strap.
Figure 7:
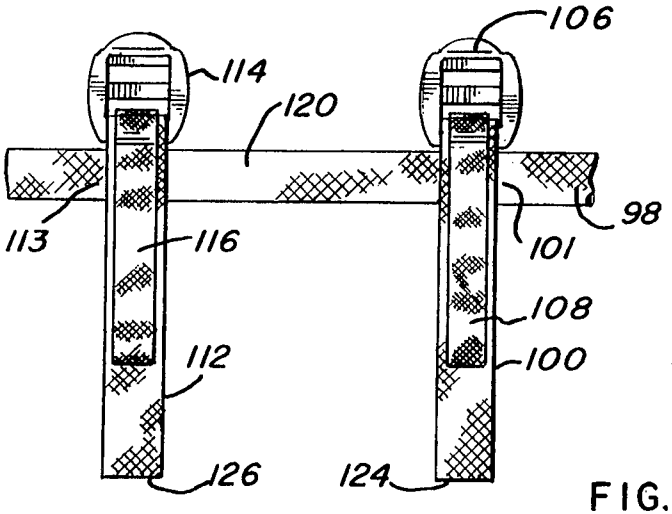
FIG. 7 is a broken out bottom plan view of the portion shown in FIG. 6 only illustrating the opposite side of the portion of the alternative shoulder strap.
Figure 6:
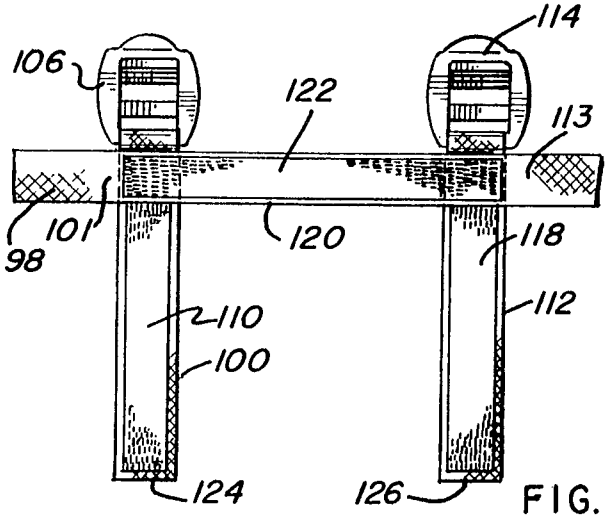
FIG. 6 is a broken out top plan view illustrating a portion of the alternative shoulder strap.

An alternative golf shoulder strap 90 is illustrated in FIGS. 5–7. The shoulder strap 90 has a first loop 92 attached to the golf bag 14 at a connection point 94 on the handle 24 and a second loop 96 attached to the golf bag 14 at a connection point 97 on the handle 24. The principal distinction between the alternative shoulder strap 90 and the shoulder strap 10 described above is that the shoulder strap 90 has a unitary construction wherein the loops 92 and 96 are collectively defined by a single elongated belt 98.

More particularly, a transverse fastening strip 100 is attached to a first portion 101 of the belt 98 intermediate the mutually opposed belt ends 102 and 104. The fastening strip 100 has a buckle 106 on one end portion and is provided on opposite sides thereof with interengageable VELCRO strips 108 and 110. A transverse fastening strip 112 is attached to a second portion 113 of the belt 98 intermediate the mutually opposed belt ends 102 and 104. The fastening strip 112 has a buckle 114 on one end portion and is provided on opposite sides thereof with interengageable VELCRO strips 116 and 118. A third portion 120 of the belt 98 extends integrally between the first and second belt portions 101 and 113, respectively, and has a longitudinally extending VELCRO strip 122 (FIG. 6) located on one side thereof with the VELCRO strip 122 overlapping junctions of the strips 100 and 122 with the first portion 101 and second portion 113, respectively.

The manner in which the belt 98 is connected to the golf bag 14 to define the loops 92 and 96 is substantially similar to the method described above for connecting the belts 36 and 54 to the golf bag 14.

That is, the first belt portion 101 is attached to the connection point 94 by wrapping the fastening strip 100 around the handle 24, drawing the free end 124 of the strip 100 through the buckle 106, and pressing together the VELCRO strips 108 and 110 on adjacent faces of the fastening strip 100. The VELCRO strip 122 on the underside of the third belt portion 120 interengages the VELCRO strip 76 on the handle 24. The loop 92 is formed by securely binding the belt end 102 in the buckle 106 such that a desired size is achieved for the loop 92.

The second belt portion 113 is attached to the connection point 97 by wrapping the fastening strip 112 around the handle 24, drawing the free end 126 of the strip 112 through the buckle 114, and pressing together the VELCRO strips 116 and 118 on adjacent faces of the fastening strip 112. The VELCRO strip 120 on the underside of the third belt portion 122 interengages the VELCRO strip 76. The loop 96 is formed by securely binding the belt end 104 in the buckle 114 such that a desired size is achieved for the loop 96.

The third belt portion 120 overlies the handle 24 and is releasably engaged therewith by means of the VELCRO strip 122 on the belt 98 and the complementary strip 76 on the handle 24.

Figure 8:
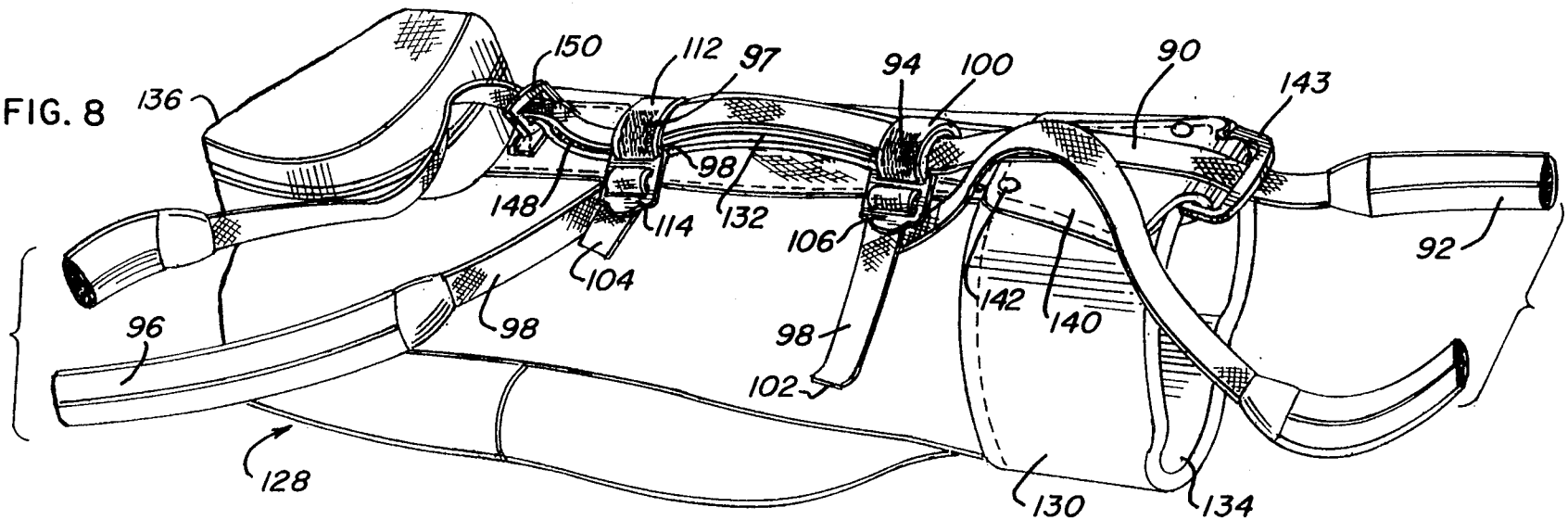
FIG. 8 is a fragmentary perspective view illustrating the shoulder strap operatively connected with an alternative golf bag.
Figure 9:
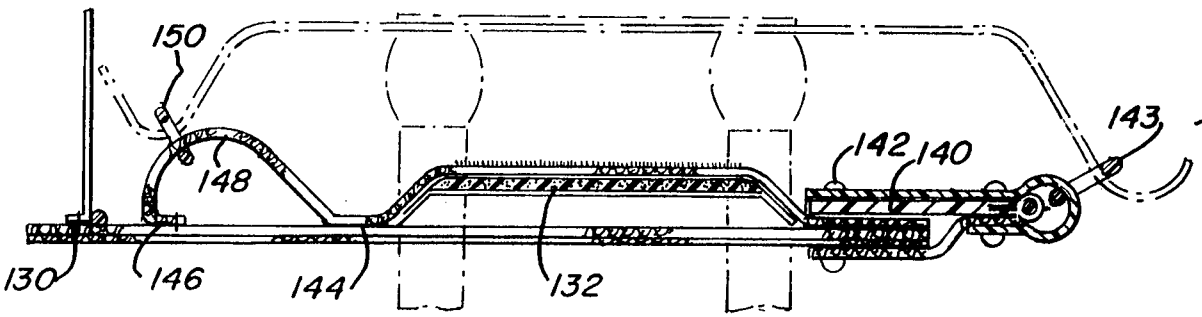
FIG. 9 is a sectional view illustrating the handle construction in the alternative golf bag.

FIG. 8 illustrates the shoulder strap 90 in operative connection with an alternative golf bag, generally designated 128. The golf bag 128 has a tubular receptacle 130 with an elongated handle 132 extending longitudinally along the exterior of the receptacle between an open upper end 134 and a closed lower end 136. The upper end of the handle 132 is sandwiched between opposite sides of a reinforcement structure 140 located at the open golf bag end 134. The reinforcement structure 140 and the interposed end of the handle 132 are connected to the receptacle 130 with a plurality of rivets 142. A ring 143 is pivotally secured to the upper end of the golf bag 128 by the reinforcement structure 140. As shown in FIG. 9, the lower end of the handle 132 is sewn to the receptacle 130 at a first location 144 and at a second location 146. The lower handle end thus defines a loop 148 for movable mounting a second ring 150.

The belt end 102 of loop 92 is threaded through the ring 143 prior to securing the belt end to the buckle 106. Similarly, the belt end 104 of loop 96 is threaded through the ring 150 prior to securing the belt end to the buckle 114. When the golf bag 130 is supported by the shoulder strap 90 (such that the loops 92 and 96 are in tension), the belt 98 applies an upward force to the golf bag at the secondary support points defined by the rings 143 and 150 in addition to the primary supports (connection points) 94 and 97. Distribution of support force between the connection points 94 and 97 and the rings 143 and 150 reduces the tendency of the golf bag 130 to rotate when the bag is carried. The position of the lower secondary support point is variable since the ring 150 is movable along the length of the loop 148 and can be adjusted to maximize the comfort with which the strap 90 is used to carry the golf bag 130.

Figure 10:
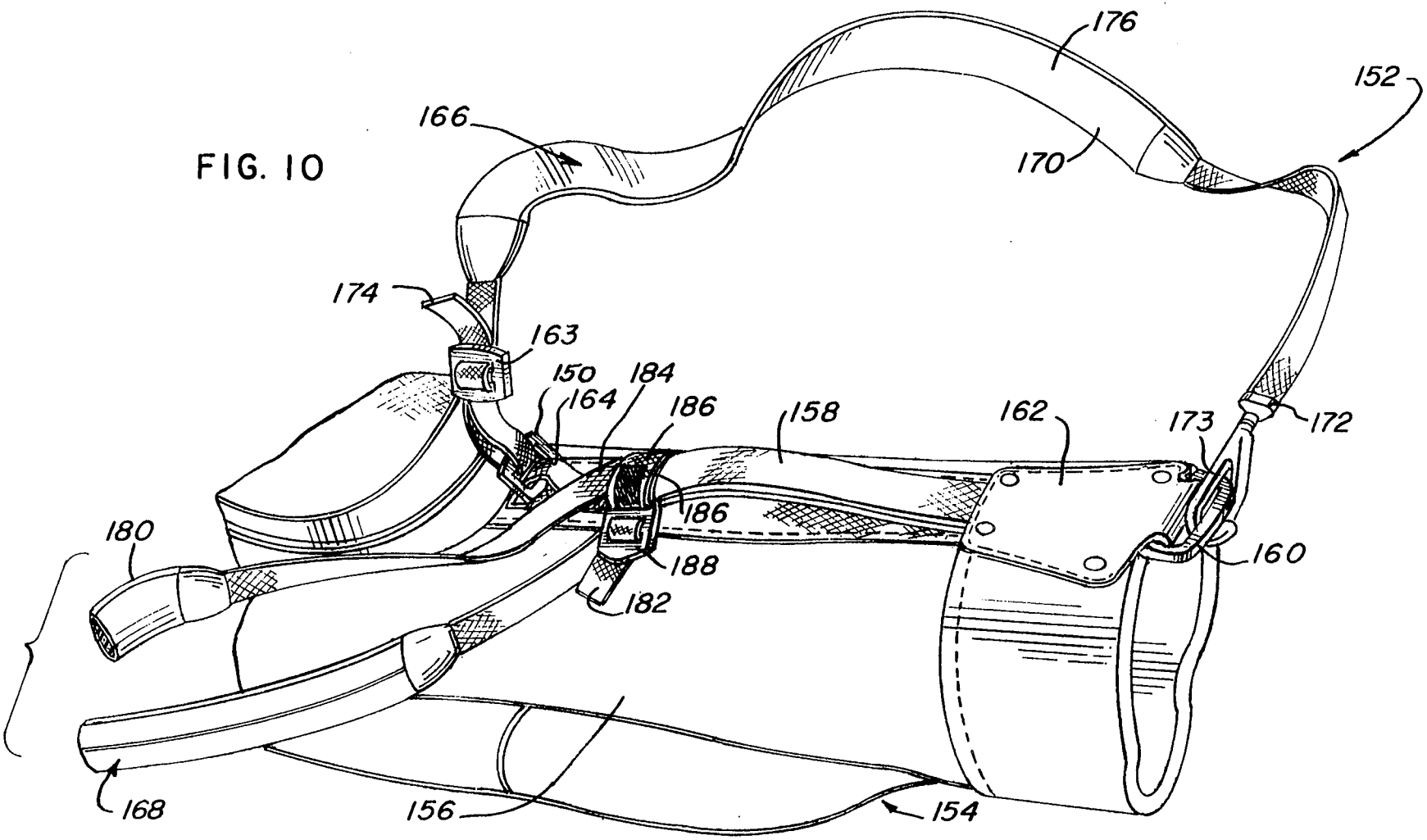
FIG. 10 is a fragmentary perspective view illustrating a second alternative embodiment of the shoulder strap.

Another alternative form of a shoulder strap according to the invention is generally designated 152 in FIG. 10 and is used to carry a golf bag 154. The golf bag 154 has a tubular receptacle 156 with an elongated handle 158 extending lengthwise of the receptacle 156. An attachment ring 160 forming a secondary support point is connected to the receptacle 156 near the open end thereof by means of a reinforcement structure 162. An attachment ring 150 forming another secondary support point is connected to the receptacle 156 near the lower end of the handle by means of a flexible loop 164 sewn to the receptacle 156.

The shoulder strap 152 includes a first loop 166 and a second loop 168. The loop 166 is defined by an elongated belt 170 having mutually opposed belt ends 172 and 174. A widened load distributing central portion 176 of the belt 170 preferably includes a foam pad or other cushion material suitable for reducing discomfort when the loop 166 bears against the shoulder of an individual carrying the golf bag 154. A clasp 173 is attached to the end 172 of belt 170 and is releasably engageable with attachment ring 160. End 174 is threaded through ring 150 and is doubled back and threaded through slotted buckle 163 whereby the length of the loop 166 is adjustable to define a preferred length for the belt 170.

The loop 168 is defined by an elongated belt 180 substantially identical to the belts 30 and 34 discussed above in regard to FIG. 1. Particularly, belt 180 has mutually opposed belt ends 182 and 184. A fastening strip 186 extends transversely to the belt end 184 and wraps around the handle 158. Interengageable connection means, such as VELCRO strips, are provided on opposite sides of the fastening strip 186 whereby ends of the strip 186 are pressed together to releasably attach the belt end 184 to a connection point 186 on the golf bag 184. The loop 168 is formed by binding the belt end 182 in a slotted buckle 188 on the fastening strip 184.

As shown in FIG. 1, the dual-loop, two point shoulder strap disclosed herein (that is, the golf shoulder strap constructions 10, 90 and 152), is intended to be used to distribute the weight of the golf bag 14 and associated golf equipment across the two shoulders and back of a golfer carrying the golf bag 14. More particularly, a golfer inserts one arm through one of the loops 30,34 (in the case of the shoulder strap 10) to support the golf bag 14 at least partially on one shoulder, and a golfer inserts another arm through the other one of the loops 30,34 to support the golf bag 14 at least partially on another shoulder. Of course, when a golfer elects to transport the golf bag 14 in a cart or when a golfer chooses to carry the golf bag 14 with the handle 24, the shoulder strap easily can be detached from the golf bag 14 by simply disconnecting the VELCRO fastening strips 44 and 62 from the handle 24.

Prior to inserting his arms through the loops 30,34 and after connecting the fastening strips 44 and 62 to the handle 24, the shoulder strap easily can be adjusted to vary the position at which the golf bag 14 is suspended from the golfer's shoulders. For instance, the loop 34 can be lengthened with the buckle 66 relative to the loop 30 whereby the lower end 18 of the golf bag is lowered relative to the upper end 20 when the golf bag is carried so that the golf clubs 22 do not exit the bag. Similarly, shortening of the loop 30 with the buckle 48 causes the open end 20 of the golf bag 14 to be positioned closer to the shoulder of the golfer and causes the receptacle 16 to assume a more vertical orientation.

Weight of the golf bag 14 acts vertically through the center of gravity of the golf bag 14 and generally applies a moment tending to rotate the bag 14 around one or both of the connection points 32,35. The center of gravity of the golf bag 14 moves toward the line of action of the support forces applied to the bag at the connection points 32,35 by the tensioned loops 30,34 when the bag assumes a more vertical orientation. Thus, relative shortening of the loop 30 reduces the gravity-induced rotational tendency of the loaded golf bag 14 and thereby stabilizes the bag on the shoulders and back of a golfer.

Further, as discussed relative to the alternative golf bag 128 shown in FIGS. 8 and 9, the shoulder strap advantageously can be threaded through the secondary support rings 143 and 150 prior to defining the dual loops 92,96 (in the case of the shoulder strap 90). Comfort and stability of the golf bag 128 is enhanced by distributing support force among the connection points 94 and 97 and the spaced apart secondary supports 143 and 150.

Still other aspects, objects, and advantages of the present invention can be obtained from a study of the specification, the drawings, and the appended claims. It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. In a golf bag having a tubular receptacle with a closed lower end and an open upper end for receiving golf equipment, the receptacle having a handle extending longitudinally between the receptacle ends, the improvement comprising a shoulder strap for carrying the receptacle comprising:

a first elongated belt having mutually opposed belt ends, one of said first belt ends being connected to a first connection point on the receptacle and the other of said first belt ends being connected to a second connection point on the receptacle whereby the first belt defines a first loop;

a second elongated belt having mutually opposed belt ends; and means for connecting each of the second belt ends to the receptacle between the first and second connection points whereby the second belt defines a second loop on the receptacle.

2. The shoulder strap of claim 1 in which each of said second belt ends is connected to a third connection point on the receptacle between the first and second connection points.

3. The shoulder strap of claim 2 in which said third connection point is located on the handle.

4. The shoulder strap of claim 1 in which the first connection point and second connection point are longitudinally spaced along the length of the tubular receptacle.

5. The shoulder strap of claim 1 in which the first connection point is located at an open end of the receptacle and the second connection point is located at a point longitudinally spaced from the first connection point.

6. The shoulder strap of claim 5 in which the handle is located on the receptacle between the first and second connection points and the belt ends of the second elongate belt are connected to the handle at a third connection point.

7. A dual-loop two-point shoulder strap for carrying a golf bag comprising:

a tubular receptacle;

a single elongated belt having mutually opposed belt ends;

means for connecting one belt end and a first portion of the belt intermediate said belt ends to a first point on the receptacle for defining a first loop through which an individual inserts one arm to support the golf bag at least partially on one shoulder; and means for connecting the other belt end and a second portion of the belt intermediate said belt ends to a second point on the receptacle for defining a second loop through which the individual inserts another arm to support the golf bag at least partially on another shoulder.

8. The shoulder strap of claim 7 in which the tubular receptacle has a handle extending longitudinally along one side thereof, the first point is located at an open end of the tubular receptacle longitudinally aligned with one end of said handle, the second point is longitudinally spaced from the first point on the opposite end of said handle, and a third portion of the belt between the first portion and second portion overlies said handle between said first and second points.

9. A shoulder strap for carrying a golf bag comprising:

a first loop;

means for connecting the first loop to a first connection point on a golf bag whereby an individual inserts one arm through the first loop to support the golf bag at least partially on one shoulder;

a second loop;

means for connecting the second loop to a second connection point on the golf bag spaced apart from the first connection point whereby the individual inserts another arm through the second loop to support the golf bag at least partially on another shoulder;

the first and second loops collectively comprise a unitary belt having mutually opposed belt ends, one belt end and a first portion of the belt intermediate said belt ends being joined to the bag at one of the spaced apart connection points to define the first loop; and the other belt end and a second portion of the belt intermediate said belt ends being joined to the bag at the other of the spaced apart connection points to define the second loop.

10. The shoulder strap of claim 9 in which a third portion of the belt between the first and second portions of the belt extends between the spaced apart connection points.

11. In a golf bag having a tubular receptacle with a closed lower end and an open upper end for receiving golf equipment, the receptacle having a handle extending longitudinally between the receptacle ends, the improvement comprising a shoulder strap for carrying the receptacle comprising:

a first elongated belt having mutually opposed belt ends;

means for connecting each of the first belt ends to a first point on the receptacle whereby the first belt defines a first loop;

a second elongated belt having mutually opposed belt ends;

means for connecting each of the second belt ends to a second point on the receptacle whereby the second belt defines a second loop on the receptacle;

the first belt and the second belt are interconnected by a third elongated belt; and means extending along the length of the third belt for releasably attaching the same to the handle.

* * * * *